US009964353B2

(12) United States Patent
Lautenschlager et al.

(10) Patent No.: US 9,964,353 B2
(45) Date of Patent: May 8, 2018

(54) SYSTEM AND METHOD FOR GENERATION OF OXYGEN BY LOW-TEMPERATURE AIR SEPARATION

(71) Applicants: Tobias Lautenschlager, Gröbenzell (DE); Stefan Lochner, Grafing (DE)

(72) Inventors: Tobias Lautenschlager, Gröbenzell (DE); Stefan Lochner, Grafing (DE)

(73) Assignee: Linde Aktiengesellschaft, Munich (DE)

( * ) Notice: Subject to any disclaimer, the term of this patent is extended or adjusted under 35 U.S.C. 154(b) by 128 days.

(21) Appl. No.: 15/059,708

(22) Filed: Mar. 3, 2016

(65) Prior Publication Data

US 2016/0265841 A1 Sep. 15, 2016

(30) Foreign Application Priority Data

Mar. 13, 2015 (EP) ..... 15 000 748

(51) Int. Cl.
*F25J 3/00* (2006.01)
*F25J 3/04* (2006.01)

(52) U.S. Cl.
CPC ..... *F25J 3/04412* (2013.01); *F25J 3/0409* (2013.01); *F25J 3/0429* (2013.01); (Continued)

(58) Field of Classification Search
CPC .. F25J 3/04872; F25J 3/04878; F25J 3/04884; F25J 3/0489;
(Continued)

(56) References Cited

U.S. PATENT DOCUMENTS 4,737,177 A * 4/1988 Erickson ..... F25J 3/0409 62/646
6,347,534 B1 * 2/2002 Ha ..... F25J 3/0409 62/646
2015/0121955 A1 * 5/2015 Davidian ..... F25J 3/04412 62/643

FOREIGN PATENT DOCUMENTS

DE 102 51 485 A1 6/2003
DE 10 2009 023900 A1 12/2010
(Continued)

OTHER PUBLICATIONS

Production of Argon from Large Air Separation Units, ip.com PriorArtDatabase, Nov. 24, 2008, No. IPCOM000176762D.

*Primary Examiner* — Keith Raymond
(74) *Attorney, Agent, or Firm* — Philip H. Von Neida

(57) ABSTRACT

A system and method serve generate oxygen by low-temperature air separation in a distillation column system having a high-pressure column and a low-pressure column, a main condenser which is constructed as a condenser-evaporator, and an auxiliary column. A gaseous oxygen-containing fraction is introduced into the auxiliary column. A nitrogen-containing liquid stream from the high-pressure column, the main condenser or the low-pressure column is applied as reflux to the top of the auxiliary column. An argon-rich stream from an intermediate site of the low-pressure column is introduced into an argon removal column that has an argon removal column top condenser. The low-pressure column is arranged beside the high-pressure column, the main condenser is arranged over the high-pressure column, the auxiliary column is arranged over the main condenser, the argon removal column is arranged over the auxiliary column and the argon removal column top condenser is arranged over the argon removal column.

12 Claims, 4 Drawing Sheets

(52) U.S. Cl.
CPC ..... *F25J 3/0466* (2013.01); *F25J 3/04084* (2013.01); *F25J 3/04296* (2013.01); *F25J 3/04387* (2013.01); *F25J 3/04393* (2013.01); *F25J 3/04448* (2013.01); *F25J 3/04648* (2013.01); *F25J 3/04654* (2013.01); *F25J 3/04666* (2013.01); *F25J 3/04678* (2013.01); *F25J 3/04872* (2013.01); *F25J 3/04878* (2013.01); *F25J 3/04884* (2013.01); *F25J 2200/32* (2013.01); *F25J 2205/30* (2013.01); *F25J 2240/10* (2013.01); *F25J 2245/58* (2013.01)

(58) Field of Classification Search
CPC .. F25J 3/04654–3/04727; F25J 3/04424; F25J 3/0443; F25J 3/04412; F25J 3/04436; F25J 3/04442; F25J 3/04448; F25J 3/04454; F25J 2200/32; F25J 2200/34; F25J 2200/04; F25J 2200/08; F25J 2200/10; F25J 2210/40; F25J 2290/40; F25J 2290/42
See application file for complete search history.

(56) References Cited

FOREIGN PATENT DOCUMENTS

| | | | |
|---|---|---|---|
| FR | 2 964 451 | A3 | 3/2012 |
| WO | WO 2014/135271 | A2 | 9/2014 |
| WO | WO 2014/169989 | A1 | 10/2014 |

* cited by examiner

SYSTEM AND METHOD FOR GENERATION OF OXYGEN BY LOW-TEMPERATURE AIR SEPARATION

CROSS-REFERENCE TO RELATED APPLICATIONS

The present application claims priority from European Patent Application EP 15000748.2 filed on Mar. 13, 2015.

BACKGROUND OF THE INVENTION

The invention relates to a system for generation of oxygen by low-temperature air separation by low-temperature air separation having

- a high-pressure column and a low-pressure column,
- a main condenser which is constructed as a condenser-evaporator, wherein the liquefaction space of the main condenser is flow-connected to the top of the high-pressure column and the evaporation space of the main condenser is flow-connected to the low-pressure column,
- an oxygen product line that is connected to the low-pressure column,
- an auxiliary column,
- means for introducing a gaseous fraction, the oxygen content of which is equal to that of air or higher, into the sump region of the auxiliary column having
- a reflux liquid line for introducing a liquid stream from the high-pressure column, the main condenser, or the low-pressure column as reflux to the top of the auxiliary column, wherein the liquid stream has a nitrogen content that is at least equal to that of air.

The fundamentals of low-temperature air separation in general and also the structure of two-column systems especially, are described in the monograph "Tieftemperaturtechnik" [Low-temperature technology] by Hausen/Linde (2nd edition, 1985) and in an essay by Latimer in Chemical Engineering Progress (Vol. 63, No. 2, 1967, page 35). The heat exchange relationship between high-pressure column and low-pressure column of a double column is generally implemented by a main condenser in which overhead gas of the high-pressure column is liquefied against evaporating sump liquid of the low-pressure column.

SUMMARY OF THE INVENTION

The distillation column system of the invention can in principle be constructed as a classical two-column system having a high-pressure column and low-pressure column. In addition to the two separation columns for nitrogen-oxygen separation, the system can have further devices for recovery of other air components, in particular noble gases, for example a krypton-xenon recovery.

The main condenser is constructed in the invention as a condenser-evaporator. A heat exchanger is designated a "condenser-evaporator", in which a first condensing fluid stream enters into indirect heat exchange with a second evaporating fluid stream. Each condenser-evaporator has a liquefaction space and an evaporation space, that consist of liquefaction passages and evaporation passages, respectively. In the liquefaction space, the condensation (liquefaction) of the first fluid stream is carried out, and in the evaporation space, the evaporation of the second fluid stream. Evaporation and liquefaction spaces are formed by groups of passages in a heat-exchange relationship with one another.

In this case, the main condenser can be constructed as a single- or multistorey bath evaporator, in particular as a cascade evaporator (for example as described in EP 1287302 B1=U.S. Pat. No. 6,748,763 B2), or else as a falling-film evaporator. It can be formed by a single heat-exchange block or else by a plurality of heat-exchange blocks, which are arranged in a shared pressure vessel.

A "main heat exchanger" serves for cooling feed air in indirect heat exchange with return streams from the distillation column system. It can be formed from a single heat-exchange section or a plurality of parallel- and/or serial-connected heat-exchange sections, for example from one or more plate heat-exchanger blocks. Separate heat exchangers that serve especially for evaporation or pseudo-evaporation of a single liquid or supercritical fluid, without heating and/or evaporation of a further fluid, are not part of the main heat exchanger.

The relative spatial expressions "top", "bottom", "over", "under", "above", "below", "beside", "next to one another", "vertical", "horizontal", etc. relate here to the spatial orientation of the separation columns in standard operation. An arrangement of two columns or apparatus parts "one above the other" is understood here to mean that the upper end of the lower of the two apparatus parts is situated at a lower or equal geodetic height as the lower end of the upper of the two apparatus parts and the projections of the two apparatus parts intersect in a horizontal plane. In particular, the two apparatus parts are arranged exactly one above the other, that is to say the axes of the two columns run on the same vertical straight line.

A system of the type mentioned at the outset and a corresponding method are known from DE 1136355 B.

The object of the invention is to equip such a system with a particularly high capacity for oxygen production and at the same time to design it to be so compact that it can be prefabricated as far as possible and then transported to the construction site. For such transports, there are strict limitations with respect to height (transport length) and diameter (transport width) of the separation columns. For example, column diameters of a maximum of 4.8 m are frequently prescribed.

This object is achieved by a system for generation of oxygen by low-temperature air separation having

- a high-pressure column and a low-pressure column,
- a main condenser which is constructed as a condenser-evaporator, wherein the liquefaction space of the main condenser is flow-connected to the top of the high-pressure column and the evaporation space of the main condenser is flow-connected to the low-pressure column,
- an oxygen product line that is connected to the low-pressure column,
- an auxiliary column,
- means for introducing a gaseous fraction, the oxygen content of which is equal to that of air or higher, into the sump region of the auxiliary column and having
- a reflux liquid line for introducing a liquid stream from the high-pressure column, the main condenser, or the low-pressure column as reflux to the top of the auxiliary column, wherein the liquid stream has a nitrogen content that is at least equal to that of air, characterized by
- an argon removal column that is flow-connected to an intermediate site of the low-pressure column,
- an argon removal column top condenser that is constructed as a condenser-evaporator, wherein the liquefaction space of the argon removal column top condenser is flow-connected to the top of the argon removal column, a crude oxygen line for introducing liquid crude oxygen from the sump of the high-pressure column into the evaporation space of the argon removal column top condenser and by a configuration of the columns, in which the low-pressure column is arranged beside the high-pressure column, the main condenser is arranged over the high-pressure column, the auxiliary column is arranged over the main condenser, the argon removal column is arranged over the auxiliary column and the argon removal column top condenser is arranged over the argon removal column.

In particular, an argon removal column and an auxiliary column are used and the columns are erected in a particularly advantageous manner.

An "argon removal column" here denotes a separation column for argon-oxygen separation which does not serve for recovering a pure argon product, but rather for removing argon from the air that is to be separated in high-pressure column and low-pressure column. The connection thereof differs only slightly from the classical crude argon column, but it contains markedly fewer theoretical plates, namely fewer than 40, in particular between 15 and 30. As with a crude argon column, the sump region of an argon removal column is connected to an intermediate site of the low-pressure column and the argon removal column is cooled by a top condenser, on the evaporation side of which expanded sump liquid from the high-pressure column is introduced; an argon removal column has no bottom evaporator.

In the auxiliary column, a part of the feed air is treated, in particular at least a part of a turbine-expanded air stream that is passed neither into the high-pressure column nor into the low-pressure column.

At first, in the light of the effort to achieve a particularly compact system, it appears to be contradictory to use two columns that are additional to the customary columns, namely high-pressure column and low-pressure column. In the context of the invention, however, it has surprisingly been found that overall, both a particularly high capacity and a good degradeability results. The combination according to the invention of auxiliary column, argon removal column and column arrangement leads to a particularly advantageous system.

At the top of the auxiliary column, preferably a first gaseous nitrogen product is recovered, and at the top of the low-pressure column a second gaseous nitrogen product is recovered. These two nitrogen products can, for example, be combined and warmed together in a counterflow subcooler, and in a heat exchanger, to about ambient temperature.

In many cases it is more expedient to pass the first and second overhead fraction through the main heat exchanger separately—that is to say in separate passage groups—and to warm these fractions in this case against feed air for the high-pressure column. Then, for example the top of the low-pressure column, can be operated at particularly low pressure of, for example, 1.0 to 1.6 bar, wherein, at the top of the auxiliary column, an about 0.1 to 0.3 bar higher pressure of 1.1 to 1.7 bar prevails which is sufficient in order to use the overhead gas of the first gaseous overhead fraction from the auxiliary column as regenerating gas for a molecular sieve station for air purification. Via the particularly low low-pressure column pressure, the energy consumption of the system is reduced.

In a further embodiment of the invention, gas from the evaporation space of the argon removal column top condenser is introduced into the auxiliary column. This gas can in advance be mixed with the gaseous fraction, the oxygen content of which is equal to that of air or higher, and together therewith be fed to the auxiliary column, for example at the sump. Alternatively, only the gas from the argon removal column top condenser is introduced at the sump of the auxiliary column, and the other gaseous fraction at an intermediate site above a mass transfer section. As a result, the low-pressure column can be more intensively relieved and thereby the capacity of the overall system increased.

It is further expedient when the means for introducing a gaseous fraction, the oxygen content of which is equal to that of air or higher, into the auxiliary column are constructed as means for introducing turbine-expanded air into the auxiliary column. The turbine air, or only part, need be introduced into the low-pressure column hereby.

The invention further relates to a method for the generation of oxygen by low-temperature air separation in a distillation column system that comprises a high-pressure column and a low-pressure column, a main condenser which is constructed as a condenser-evaporator, wherein the liquefaction space of the main condenser is flow-connected to the top of the high-pressure column and the evaporation space of the main condenser is flow-connected to the low-pressure column and an auxiliary column, wherein an oxygen stream is taken off from the low-pressure column and is recovered as oxygen product, a gaseous fraction, the oxygen content of which is equal to that of air or higher, is introduced into the sump region of the auxiliary column, a liquid stream from the high-pressure column, the main condenser or the low-pressure column is applied as reflux to the top of the auxiliary column, wherein the liquid stream has a nitrogen content that is at least equal to that of air, characterized in that an argon-rich stream is introduced from an intermediate site of the low-pressure column into an argon removal column, reflux for the argon removal column is generated in an argon removal column top condenser that is constructed as a condenser-evaporator, wherein the liquefaction space of the argon removal column top condenser is flow-connected to the top of the argon removal column, crude oxygen is introduced from the sump of the high-pressure column into the evaporation space of the argon removal column top condenser, wherein the low-pressure column is arranged beside the high-pressure column, the main condenser is arranged over the high-pressure column, the auxiliary column is arranged over the main condenser, the argon removal column is arranged over the auxiliary column and the argon removal column top condenser is arranged over the argon removal column.

A first gaseous overhead fraction is recovered from the auxiliary column as first gaseous nitrogen product.

A second gaseous overhead fraction is recovered from the low-pressure column as second gaseous nitrogen product.

The first and second overhead fractions are passed separately through a main heat exchanger for warming these fractions against feed air for the high-pressure column.

The gas from the evaporation space of the argon removal column top condenser is introduced into the auxiliary column.

The gaseous fraction, the oxygen content of which is equal to that of air or higher, is formed by turbine-expanded air.

The low-pressure column is arranged beside the high-pressure column, the main condenser is arranged over the high-pressure column, the auxiliary column is arranged over the main condenser or over the low-pressure column, the argon removal column is arranged over the auxiliary column or at the same height as the auxiliary column or over the main condenser and the argon removal column top condenser is arranged over the argon removal column.

BRIEF DESCRIPTION OF THE DRAWINGS

The invention and also further details of the invention are discussed in more detail hereinafter with reference to exemplary embodiments shown schematically in the drawings. In the drawings.

DETAILED DESCRIPTION OF THE INVENTION

Figure 1:
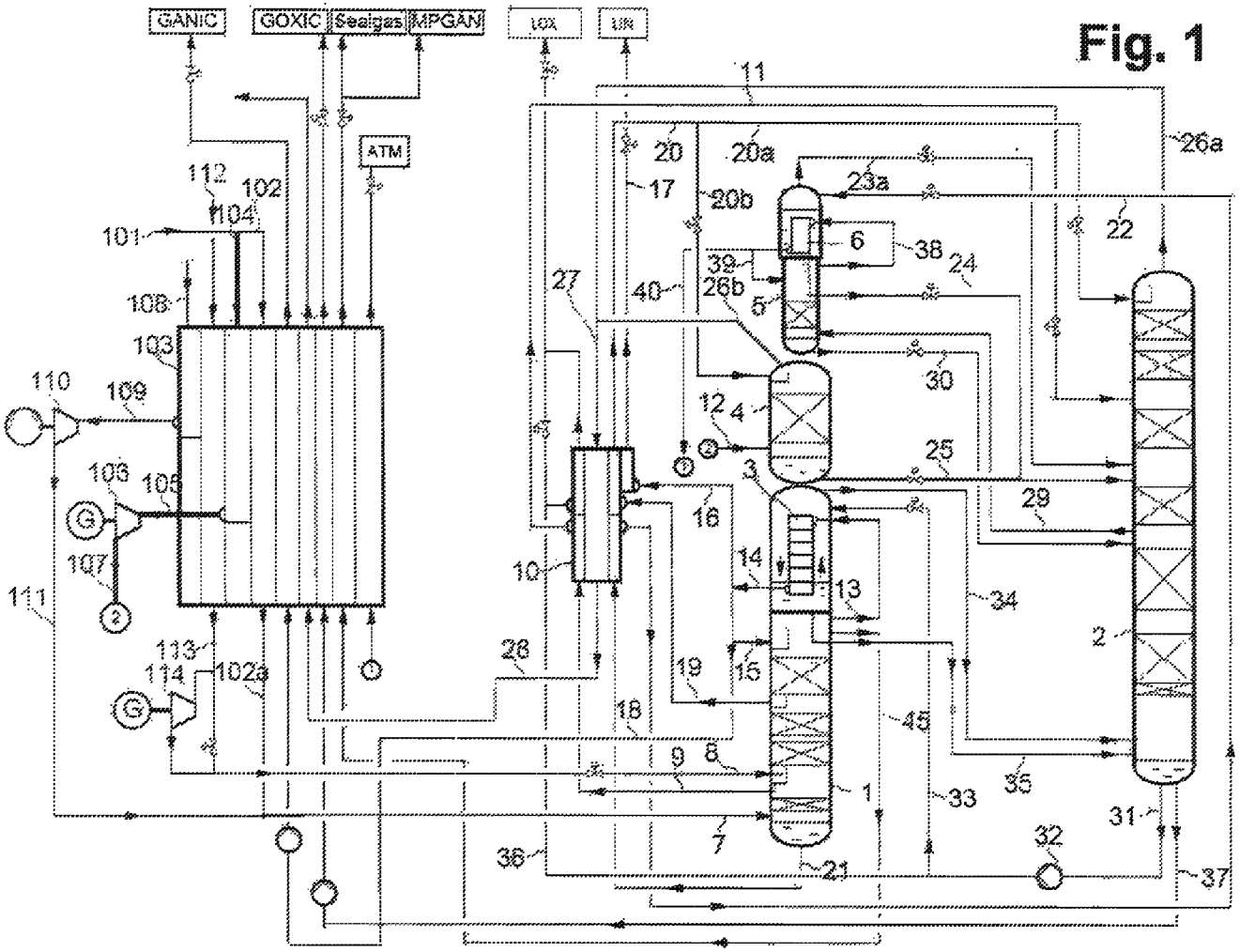
FIG. 1 shows a first exemplary embodiment of the invention with combination of the two overhead fractions of auxiliary column and low-pressure column.

The main heat exchanger 103 with accessories such as the expansion turbines 106, 110, 114, is only shown in FIG. 1. In the exemplary embodiments of FIGS. 2 to 4, it appears exactly the same, even though it is not shown in the drawings.

The distillation column system of the system in FIG. 1 has a high-pressure column 1, a low-pressure column 2, a main condenser 3, an auxiliary column 4, an argon removal column 5 and an argon removal column top condenser 6. In the exemplary embodiment, the main condenser 3 is constructed as a six-storey cascade evaporator and the argon removal column top condenser 6, as a single-storey bath evaporator. The auxiliary column, in Example 20, contains practical or theoretical plates. If an ordered packing is used, it is advantageous to select a particularly high specific surface area, for example 1200 $m^2/m^3$.

Compressed and purified feed air is provided at three different pressures. A first pressure prevails in line 101. A first part 102 of the air at the first pressure is cooled in the main heat exchanger 103 up to the cold end and forms the air stream 102*a*. A second part 104 of air at the first pressure is cooled in the main heat exchanger 103 to an intermediate temperature. The air at intermediate temperature 105 is fed to a first expansion turbine 106 and there work-producingly expanded. The turbine-expanded air 107 forms a "third feed air stream" and is passed to the auxiliary column 4 via line 12.

The air 108 is at a second higher pressure, is cooled in the main heat exchanger 103 to an intermediate temperature, passed via line 109 to a second expansion turbine 110 and work-producingly expanded in order to form the air stream 111.

At a still higher third pressure, a further air stream, termed throttle stream 112, is cooled in the main heat exchanger and liquefied—or pseudoliquefied, if the pressure is supercritical. The liquid or supercritical throttle stream 113 here—contrary to its name—is not throttle-expanded, but work-producingly expanded in a liquid turbine (dense fluid turbine) 114. The resultant liquid air 8 forms a "second feed air stream".

A first feed air stream 7 is formed from the air streams 102*a* and 111 and is introduced in the gaseous state into the high-pressure column 1, more precisely immediately above the sump. The second feed air stream 8 is fed somewhat higher into the high-pressure column 1 principally in the liquid state. A part 9 thereof is withdrawn straight away, cooled in a counterflow subcooler 10 and introduced via line 11 into the low-pressure column 2. The third feed air stream 107 from the expansion turbine 106 is fed via line 12 in the gaseous state into the auxiliary column 4 at the sump.

As a departure from the exemplary embodiment, the liquid air stream 11, a part thereof, or a different liquid air stream, could be passed to the auxiliary column 4, in particular at an intermediate site. The auxiliary column would then have not only one mass transfer section as in the exemplary embodiment, but two mass transfer sections, between which the liquid air is fed in.

A part 13 of the overhead nitrogen of the high-pressure column 1 is condensed in the main condenser 3. The resultant liquid nitrogen 14 that is generated is fed back in a first part 15 into the high-pressure column 1 and serves there as reflux. A second part 16/17 is cooled in the counterflow subcooler 10 and is recovered as liquid nitrogen product (LIN). The third part 18 of the liquid nitrogen 14 from the main condenser 3 is fed to an internal compression and finally recovered as gaseous pressurised product (GANIC). Liquid impure nitrogen 19 from an intermediate site of the high-pressure column 1 is subcooled in the counterflow subcooler 10. The subcooled impure nitrogen 20 is applied in a first part 20*a* to the top of the low-pressure column 2. The remainder flows via line 20*b* to the top of the auxiliary column.

Liquid crude oxygen 21 from the sump of the high-pressure column is likewise conducted to the counterflow subcooler 10 and then passed via line 22 into the evaporation space of the argon removal column top condenser 6. The gas 23*a* formed in the evaporation space is fed to the low-pressure column 2 at an intermediate site, just as is the fraction 24 remaining liquid and the sump liquid 25 of the auxiliary column 4.

The overhead product of the auxiliary column 4 is conducted as first gaseous overhead fraction 26*b* via the lines 27 and 28 through the counterflow subcooler 10 and further to the main heat exchanger 103, and is finally recovered as first gaseous nitrogen product or fed to the air purification, which is not shown, as regenerating gas. The overhead product of the low-pressure column 2 is taken off as second gaseous overhead fraction 26*a*, combined with the first gaseous overhead fraction 26*b*, passed via the lines 27 and 28 through the counterflow subcooler 10 and further to the main heat exchanger 103 and finally recovered as second gaseous nitrogen product (together with the first). Overhead nitrogen 45 of the high-pressure column 1 is warmed in the main heat exchanger 103 and recovered as medium-pressure nitrogen product (MPGAN); a part can be used as sealing gas (SEALGAS).

From an intermediate site of the low-pressure column 2, an argon-rich stream 29 is taken off and passed to the argon removal column 5. Liquid 30 flows in countercurrent from the sump of the argon removal column 5 back into the low-pressure column.

Overhead gas 38 of the argon removal column is passed into the liquefaction space of the argon removal column top condenser 6. Liquid 39 generated there is applied as reflux to the argon removal column 5. Remaining gas 40 that has a high argon content is warmed in a separate passage group in the main heat exchanger 103.

A first part 33 of the liquid oxygen in the sump of the low-pressure column 2 is passed via line 31 and pump 32 into the evaporation space of the main condenser 3. Gas 34 generated there and remaining liquid 35 are fed back into the low-pressure column 2. If there is a requirement for a liquid oxygen product (LOX), for this purpose a second part 36 of the liquid oxygen in the sump of the low-pressure column 2 can be used, optionally after cooling in the counterflow subcooler 10. A third part 37 is fed to an internal compression and then forms the main product of the system, namely a gaseous pressurised oxygen product (GOXIC).

The columns and condensers are arranged in the following way:

The low-pressure column 2 stands beside the high-pressure column 1.

The main condenser 3 sits over the high-pressure column 1.

The auxiliary column 4 is arranged over the main condenser 3.

The argon removal column 5 is seated over the auxiliary column 4.

The argon removal column top condenser 6 is mounted over the argon removal column 5.

Alternatively, auxiliary column 4 and argon removal column 5 can be arranged in the following ways:

The auxiliary column 4 is arranged over the low-pressure column 2.

The argon removal column 5 is seated over the main condenser 3.

The argon removal column top condenser 6 is mounted over the argon removal column 5.

Figure 2:
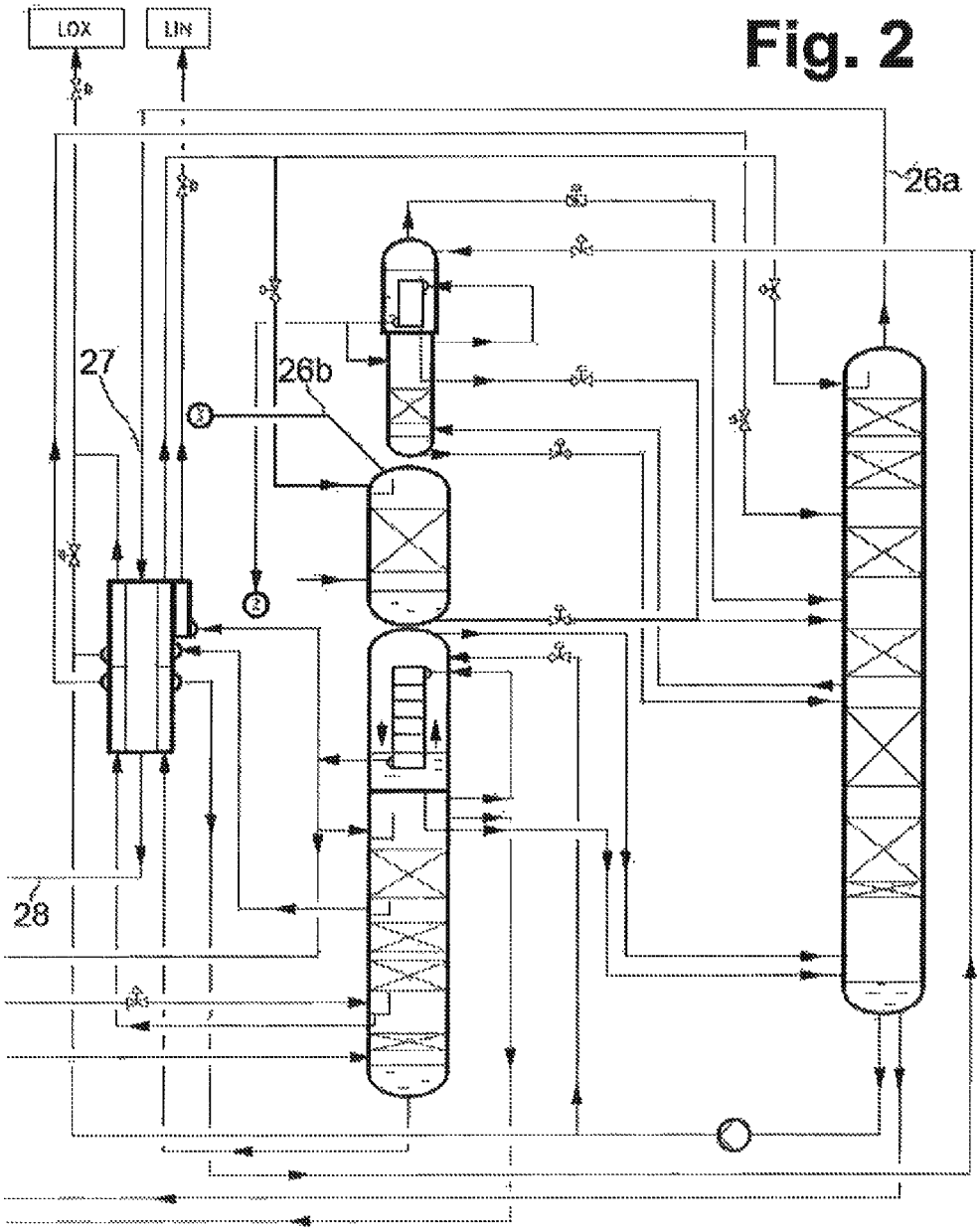
FIG. 2 shows a second exemplary embodiment with separate conduction of the two overhead fractions.

FIG. 2 differs from FIG. 1 solely in that only the second gaseous overhead fraction (26*a*) from the low-pressure column 2 is conducted through the lines 27, 28 and the counterflow subcooler 10. The first gaseous overhead fraction 26*b*, in contrast, is conducted past the counterflow subcooler and flows through separate passages in the main heat exchanger. This feature can also be effected in the systems of the following FIGS. 3 and 4.

Figure 3:
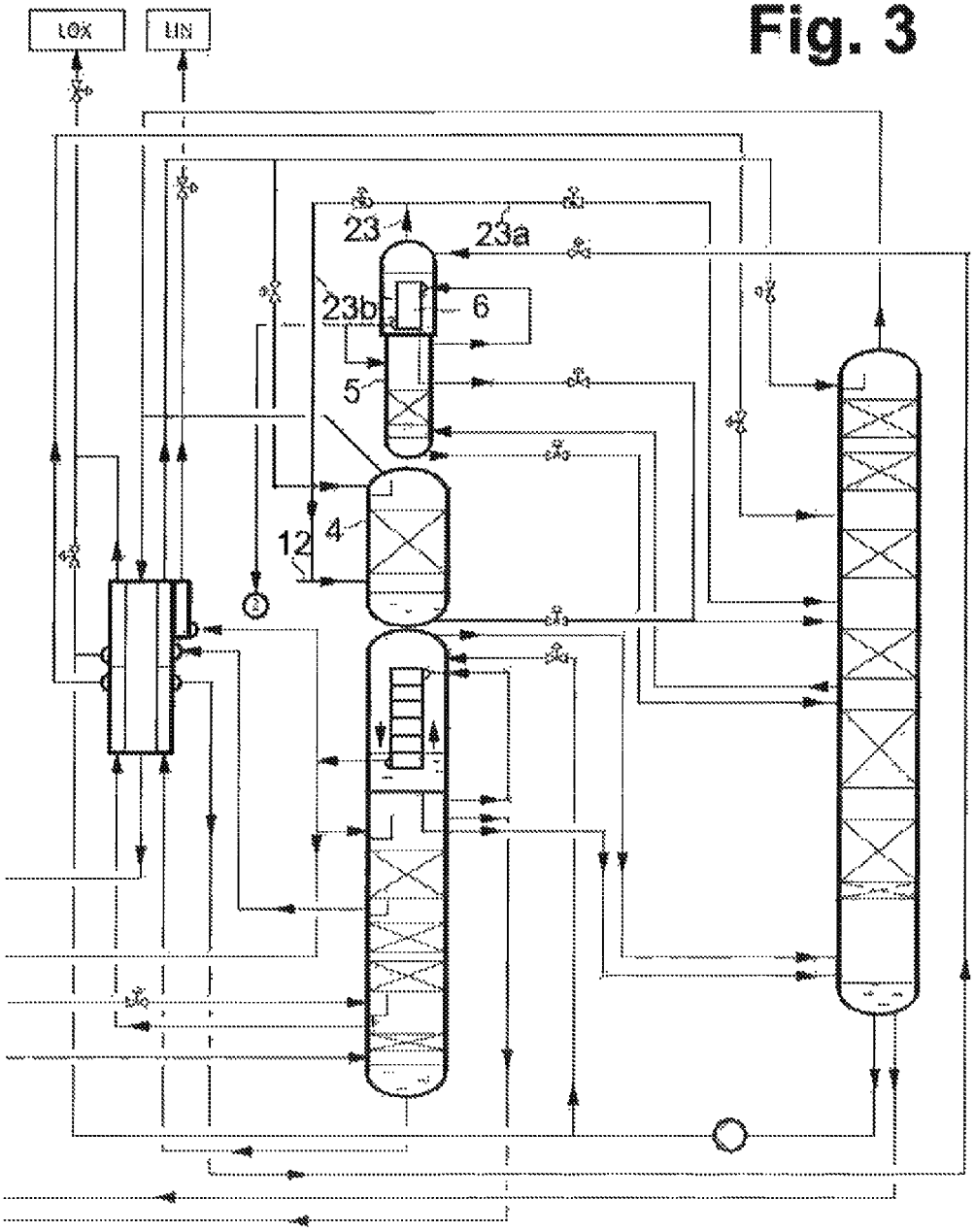
FIG. 3 shows a third exemplary embodiment with introduction of gas from the argon removal column top condenser into the auxiliary column and FIG. 4 shows a modification of FIG. 3 with an additional mass transfer section in the auxiliary column.

In FIG. 3, only a part 23*a* of the gas 23 from the evaporation space of the argon removal column top condenser is passed into the low-pressure column 2. The remainder 23*b* flows into the auxiliary column 4, more precisely together with the turbine-expanded air.

Figure 4:
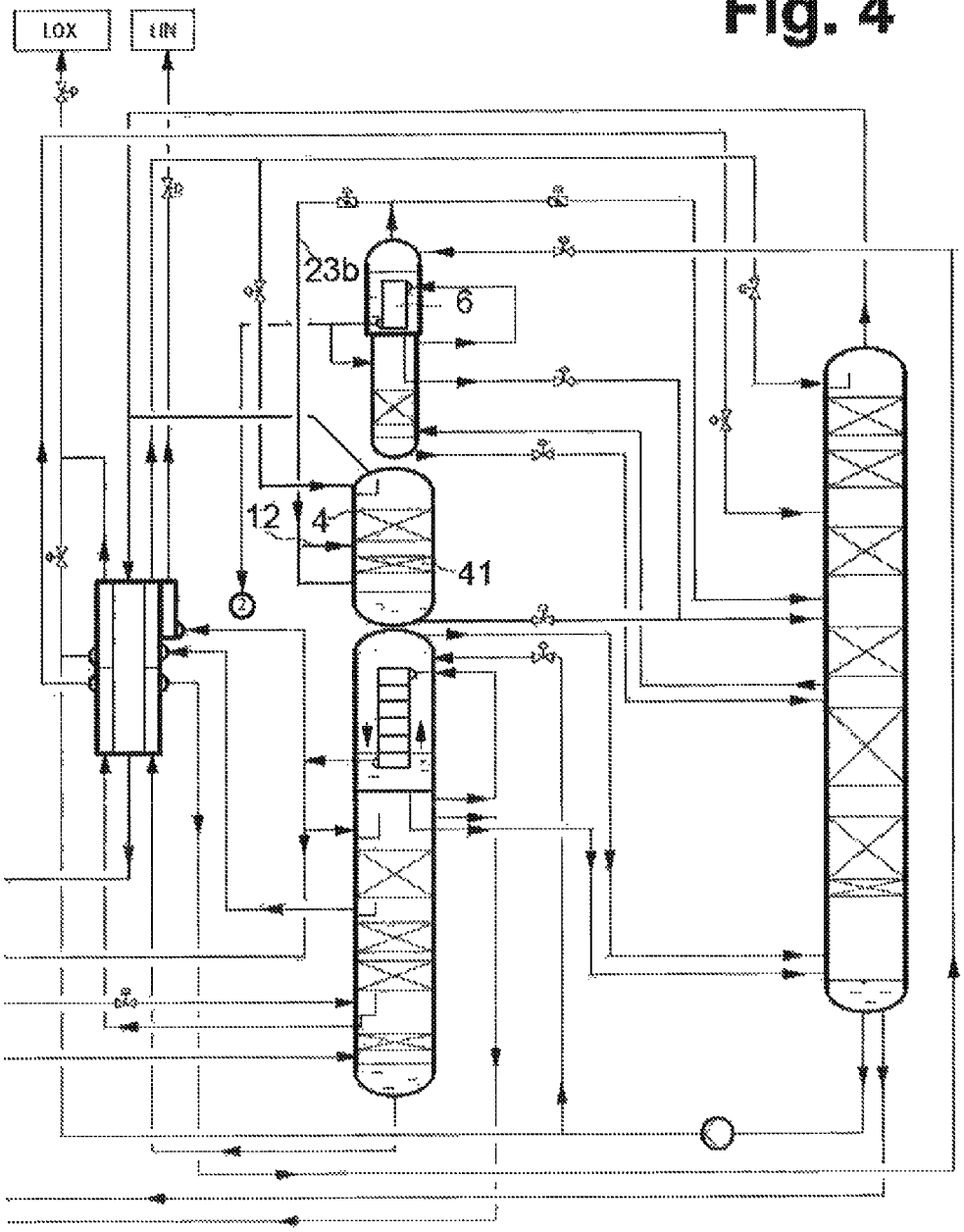

In FIG. 4, the auxiliary column 4 has an additional mass transfer section 41, wherein the gas 23*b* from the argon removal column top condenser 6 is introduced below this mass transfer section, and the turbine-expanded air 12 above.

What we claim is:

1. A system for generation of oxygen by low-temperature air separation comprising a high-pressure column and a low-pressure column, a main condenser which is constructed as a condenser-evaporator, wherein a liquefaction space of the main condenser is flow-connected to the top of the high-pressure column and an evaporation space of the main condenser is flow-connected to the low-pressure column, an oxygen product line that is connected to the low-pressure column, an auxiliary column, introducing a gaseous fraction, the oxygen content of which is equal to that of air or higher, into a sump region of the auxiliary column and having a reflux liquid line for introducing a liquid stream from the high-pressure column, the main condenser, or the low-pressure column as reflux to the top of the auxiliary column, wherein the liquid stream has a nitrogen content that is at least equal to that of air, characterized by an argon removal column that is flow-connected to an intermediate site of the low-pressure column, an argon removal column top condenser that is constructed as a condenser-evaporator, wherein a liquefaction space of the argon removal column top condenser is flow-connected to the top of the argon removal column, a crude oxygen line for introducing liquid crude oxygen from a sump of the high-pressure column into an evaporation space of the argon removal column top condenser and wherein the low-pressure column is arranged beside the high-pressure column, the main condenser is arranged over the high-pressure column, the auxiliary column is arranged over the main condenser, the argon removal column is arranged over the auxiliary column and the argon removal column top condenser is arranged over the argon removal column.

2. The system according to claim 1, characterized by recovering a first gaseous overhead fraction from the auxiliary column as first gaseous nitrogen product.

3. The system according to claim 2, characterized by recovering a second gaseous overhead fraction from the low-pressure column as a second gaseous nitrogen product.

4. The system according to claim 3, characterized by separately passing the first and second overhead fractions through a main heat exchanger for warming the first and second overhead fractions against feed air for the high-pressure column.

5. The system according to claim 1, characterized by introducing gas from the evaporation space of the argon removal column top condenser into the auxiliary column.

6. The system according to claim 1, characterized in that the introducing a gaseous fraction, the oxygen content of which is equal to that of air or higher, into the auxiliary column includes introducing turbine-expanded air into the auxiliary column.

7. A method or generation of oxygen by low-temperature air separation in a distillation column system that comprises a high-pressure column and a low-pressure column, a main condenser which is constructed as a condenser-evaporator, wherein a liquefaction space of the main condenser is flow-connected to the top of the high-pressure column and an evaporation space of the main condenser is flow-connected to the low-pressure column and an auxiliary column, wherein an oxygen stream is taken off from the low-pressure column and is recovered as oxygen product, a gaseous fraction, the oxygen content of which is equal to that of air or higher, is introduced into a sump region of the auxiliary column, a liquid stream from the high-pressure column, the main condenser or the low-pressure column is applied as reflux to the top of the auxiliary column, wherein the liquid stream has a nitrogen content that is at least equal to that of air, characterized in that an argon-rich stream is introduced from an intermediate site of the low-pressure column into an argon removal column, reflux for the argon removal column is generated in an argon removal column top condenser that is constructed as a condenser-evaporator, wherein a liquefaction space of the argon removal column top condenser is flow-connected to the top of the argon removal column, crude oxygen is introduced from a sump of the high-pressure column into an evaporation space of the argon removal column top condenser, wherein the low-pressure column is arranged beside the high-pressure column, the main condenser is arranged over the high-pressure column, the auxiliary column is arranged over the main condenser, the argon removal column is arranged over the auxiliary column and the argon removal column top condenser is arranged over the argon removal column.

8. The method according to claim 7, in which a first gaseous overhead fraction is recovered from the auxiliary column as first gaseous nitrogen product.

9. The method according to claim 8, in which a second gaseous overhead fraction is recovered from the low-pressure column as second gaseous nitrogen product.

10. The method according to claim 9, in which the first and second overhead fractions are passed separately through a main heat exchanger for warming these fractions against feed air for the high-pressure column.

11. The method according to claim 7, in which gas from the evaporation space of the argon removal column top condenser is introduced into the auxiliary column.

12. The method according to claim 7, characterized in that the gaseous fraction, the oxygen content of which is equal to that of air or higher, is formed by turbine-expanded air.

* * * * *